US008677796B2

(12) United States Patent
Carsley et al.

(10) Patent No.: US 8,677,796 B2
(45) Date of Patent: Mar. 25, 2014

(54) HEMMED METAL PANELS, HEMMING APPARATUSES, AND HEMMING METHODS

(75) Inventors: John E. Carsley, Oakland, MI (US); Anil K. Sachdev, Rochester Hills, MI (US); James C. O'Kane, Shelby Township, MI (US); Raja K Mishra, Shelby Township, MI (US); Rajesh Raghavan, Banagalore (IN)

(73) Assignee: GM Global Technology Operations LLC, Detroit, MI (US)

( * ) Notice: Subject to any disclaimer, the term of this patent is extended or adjusted under 35 U.S.C. 154(b) by 230 days.

(21) Appl. No.: 13/030,180

(22) Filed: Feb. 18, 2011

(65) Prior Publication Data

US 2012/0214015 A1 Aug. 23, 2012

(51) Int. Cl.
*B21D 37/16* (2006.01)
*B21D 7/02* (2006.01)

(52) U.S. Cl.
USPC ..... 72/342.1; 72/69; 72/214; 29/243.58

(58) Field of Classification Search
USPC ..... 72/69, 214, 220, 342.1, 342.5, 342.6, 72/342.94, 342.96, 364, 200, 202; 29/243.57, 243.58
See application file for complete search history.

(56) References Cited

U.S. PATENT DOCUMENTS

| | | | | |
|---|---|---|---|---|
| 3,738,139 | A * | 6/1973 | Proops et al. | 72/69 |
| 3,770,256 | A * | 11/1973 | Godin et al. | 266/121 |
| 3,815,395 | A * | 6/1974 | Sass | 72/69 |
| 4,843,762 | A * | 7/1989 | Grier et al. | 49/378 |
| 4,898,016 | A * | 2/1990 | Moeller et al. | 72/342.94 |
| 5,948,185 | A | 9/1999 | Krajewski et al. | |
| 6,199,419 | B1 * | 3/2001 | Shrayer et al. | 72/69 |
| 6,425,277 | B2 | 7/2002 | Wiens | |
| 6,672,121 | B2 | 1/2004 | Carsley et al. | |
| 6,810,707 | B2 * | 11/2004 | Friedman et al. | 72/220 |
| 7,290,423 | B2 | 11/2007 | Carsley et al. | |
| 8,042,372 | B2 * | 10/2011 | Carsley et al. | 72/342.94 |
| 8,341,992 | B2 * | 1/2013 | Vanimisetti et al. | 72/114 |
| 2009/0230728 | A1 * | 9/2009 | Kleber et al. | 296/191 |
| 2013/0062003 | A1 * | 3/2013 | Shulkin et al. | 156/196 |

FOREIGN PATENT DOCUMENTS

| | | | | |
|---|---|---|---|---|
| JP | 2-280930 | * 11/1990 | | B21D 39/02 |
| JP | 7-290158 | * 11/1995 | | B21D 19/12 |
| JP | 2001-252730 | * 9/2001 | | B21D 39/02 |
| JP | 2005-349471 | * 12/2005 | | B21D 19/04 |
| JP | 2006-88217 | * 4/2006 | | B21D 39/02 |
| KR | 2010028349 | * 3/2010 | | B21D 19/04 |

* cited by examiner

*Primary Examiner* — Edward Tolan

(74) *Attorney, Agent, or Firm* — Parks IP Law LLC; Mickki D. Murray, Esq.

(57) ABSTRACT

A hemming station is configured for hemming a panel assembly including an outer panel having a hem flange defined by a hem edge. The hemming station includes a roller configured to fold the hem flange, a heating device configured to heat the hem edge, and a control unit. The control unit is configured to control the roller and the heating device such that the roller folds the hem flange when the temperature of the hem edge is in a predetermined temperature range.

16 Claims, 3 Drawing Sheets

HEMMED METAL PANELS, HEMMING APPARATUSES, AND HEMMING METHODS

TECHNICAL FIELD

The technical field is generally joined metal panels, and more specifically, hemmed metal panels, hemming apparatuses, and hemming methods.

BACKGROUND

Roller hemming is a method used in the automotive industry to join two metal pre-formed panels. A conventional hemming process generally includes folding an outer panel over an inner panel. The two metal panels are typically joined into a unitary hollow structural unit such as a vehicle door, hood, or trunk lid. These hollow structural units are commonly referred to as closure panels.

Some vehicle closure panels are made of steel, which has desirable strength and impact absorbing properties. However, steel is heavy and it is desirable to substitute lighter materials where practical, for example, to improve fuel economy by reducing weight. Aluminum is one such lighter material with suitable strength and impact absorbing properties. The thickness of aluminum panels is generally greater than that of steel panels in order to achieve strength and stiffness that meets performance requirements. Magnesium and titanium are other structural metals lighter than steel.

Conventional hemming processes that have been developed for steel panels are generally not suitable for aluminum panels because such processes cause aluminum panels to crack or break along the hem edge. Some processes have been developed for aluminum panels that do not cause cracking along the hem edge. However, such processes are limited to lower strength alloys and/or limited in the sharpness of hem edge that can be produced. For example, such processes use aluminum sheet that has been softened or has been specially heat treated. The softening and special heat treatment avoids fracture of the aluminum sheet during the hemming process but carries a higher cost and reduces strength and other performance measures of the aluminum sheet.

A process that has been used with some aluminum panels is Retrogression Heat Treatment (RHT). The RHT process applies a local heat treatment and immediate quench to a flange area of an outer aluminum panel. This process temporarily softens the material by dissolving very fine precipitates present in the room-temperature aged material and favorably alters the deformation response of the material in hemming. Although this procedure improves hemmability, its use is generally restricted to a few lower-strength alloys that can respond to deformation at room temperature without fracture, and is not used on richer alloy compositions that rapidly re-harden at room temperature. Such richer alloy compositions include aluminum alloys that are age-hardened. Age hardening results in increased strength but decreased ductility.

SUMMARY

The various embodiments provide higher-strength age-hardened aluminum alloy panels that are joined with a sharp hem and apparatuses and methods for hemming higher strength age-hardened aluminum alloy panels. The hemming apparatuses and methods described herein hem much stronger, thinner, less costly materials to a sharp, "jewel-effect" appearance without causing cracking at the hem edge, without the need to heat the material above a melting point, and with the need to quench the material. Since the apparatuses and methods are applicable to stronger materials, many concessions that have to be made with other methods due to material hemmability limitations are eliminated which allows many potential improvements in performance and cost.

According to an exemplary embodiment, a hemming station is configured for hemming a panel assembly with an outer panel with a hem flange defined by a hem edge. The hemming station includes a heating device configured to heat the hem edge, a roller configured to fold the hem flange, and a control unit. The control unit is configured to control the roller and the heating device such that the roller folds a hem flange when the temperature of the hem edge is in a predetermined temperature range. For example, in one exemplary embodiment, the lower limit of the temperature range is greater than room temperature and the upper limit of the temperature range is less than the melting point of the outer panel material. In another exemplary embodiment, the temperature range is 20% to 50% of the melting point of the material.

According to another exemplary embodiment, a method for hemming a panel assembly having an outer panel with a hem flange defined by a hem edge includes heating the hem edge of the hem flange and folding the hem flange while the hem edge is at a temperature in a predetermined temperature range.

The foregoing has broadly outlined some of the aspects and features of the various embodiments, which should be construed to be merely illustrative of various potential applications. Other beneficial results can be obtained by applying the disclosed information in a different manner or by combining various aspects of the disclosed embodiments. Other aspects and a more comprehensive understanding may be obtained by referring to the detailed description of the exemplary embodiments taken in conjunction with the accompanying drawings, in addition to the scope defined by the claims.

DETAILED DESCRIPTION

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

The exemplary embodiments are described with respect to higher strength age-hardened aluminum alloys. Age-hardened aluminum alloys are advantageous because of their higher yield strength as compared to other aluminum alloys. One advantage of forming outer panels out of age-hardened aluminum alloys is greater dent resistance. Further, the increased strength allows for the use of thinner gauges, which have a lower cost.

Higher-strength age-hardened aluminum alloys include 6000-series, 2000-series, and 7000-series aluminum alloys. For reference, the yield strength for 6000-series T4 alloys ranges from approximately 125 MPa to approximately 180 MPa and the yield strength for 6000-series T6 alloys ranges from approximately 240 MPa to approximately 310 MPa. For reference, the term higher-strength as used herein can refer to metals or metal alloys with yield strength that is generally in or near the range of 125 MPa to 310 MPa and ultimate strength that is above the range.

The methods and apparatuses described herein are useful for aluminum alloys that are age-hardened as they overcome the difficulty of the reduced ductility that results from age-hardening. Further, the methods and apparatuses are able to bend age-hardened aluminum alloys to a great extent to produce a sharp hem edge such as that of a "Dutch Hem" shape. It should be understood that the teachings described herein are applicable to other metals and metal alloys with similar characteristics including non age-hardened aluminum alloys such as 3000 and 5000-series alloys, magnesium sheet alloys, and titanium sheet alloys.

Figure 1:
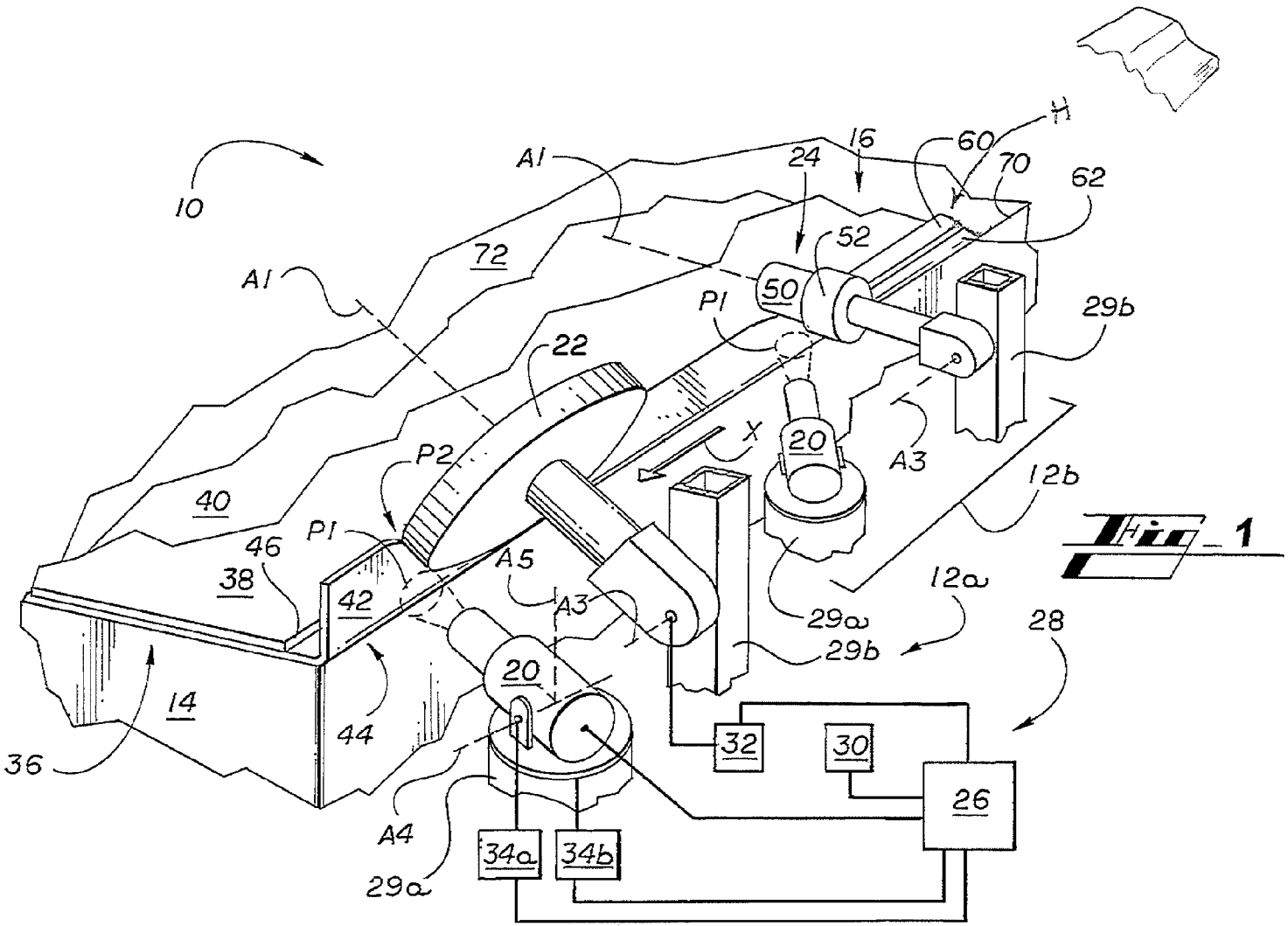
FIG. 1 is a partial perspective view of a hemming station and associated method, according to an exemplary embodiment.

Referring to FIG. 1, an exemplary hemming station 10 includes a roller apparatus 12, illustrated for two different passes as roller apparatuses 12*a*/12*b*, and an anvil 14. The anvil 14 is configured to position and secure a panel assembly 16 such that the roller apparatus 12 can operate on the panel assembly 16 by traversing along an edge 70 of the anvil 14. The anvil 14 includes a support surface 72 on which the panel assembly 16 is placed and located. In various embodiments, the panel assembly 16 is secured in place on the anvil 14 for being worked in various ways, such as by clamping.

Figure 3:
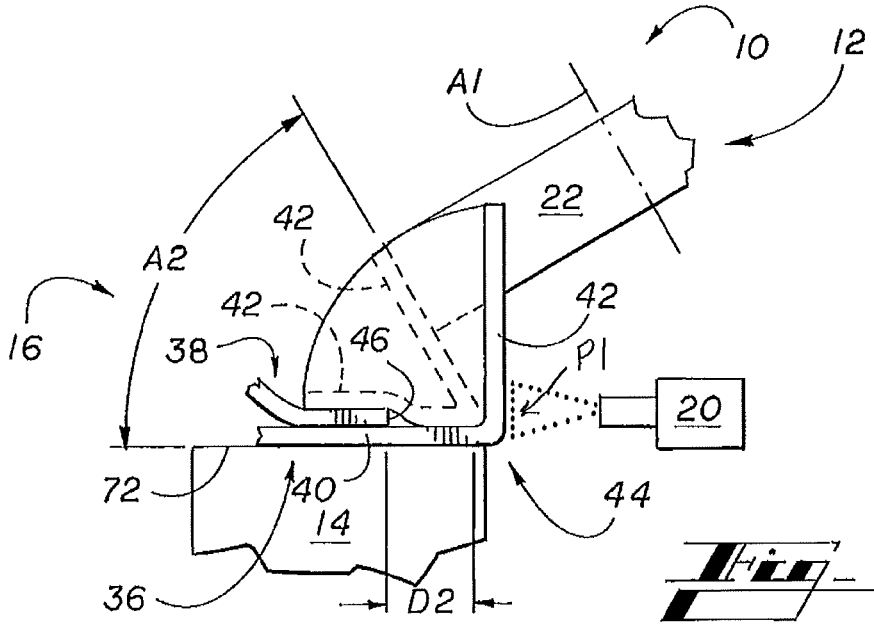
FIGS. 3 and 4 are partial side elevational views of the hemming station and associated method of FIG. 1.

The panel assembly 16 includes an outer panel 36 and an inner panel 38. The outer panel 36 includes a main panel 40 and a hem flange 42 defined by a hem edge 44. In some embodiments, the hem flange 42 and the hem edge 44 are formed during a stamping process prior to hemming the panel assembly 16 at the hemming station 10. In some embodiments, the hem flange 42 is initially stamped to be at substantially ninety degrees with respect to the main panel 40. In other embodiments, the hem flange 42 is stamped to be greater than ninety degrees, such as up to one-hundred thirty-five degrees. The inner panel 38 includes an inner edge 46 over which the hem flange 42 is folded as described in further detail below with respect to FIGS. 3-5. As shown in FIG. 3, the inner edge 46 is positioned at a distance D2 with respect to the hem edge 44. The hem edge 44 is positioned along the edge 70 of the anvil 14.

Figure 6:
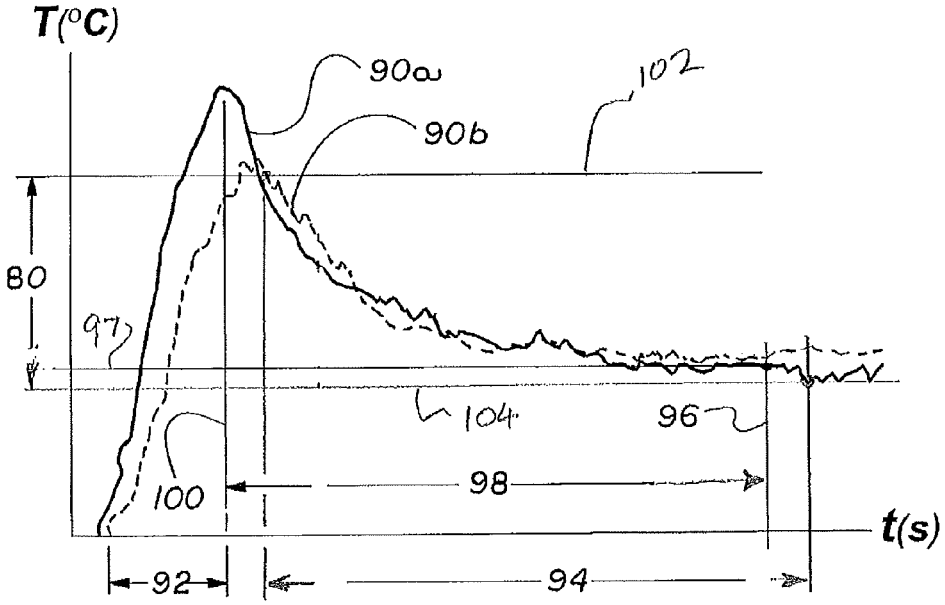
FIG. 6 is a graphical illustration of the temperature at a location of a hem associated with the hemming station of FIG. 1.

Referring to FIGS. 1-5, generally described, the roller apparatus 12 is configured to heat the hem edge 44 as described herein and fold the hem flange 42 while the temperature of the hem edge 44 is within a temperature range 80 (see FIG. 6). The hem flange 42 is folded in one or more passes. The roller hemming is in some embodiments performed in multiple passes since, during hemming, the hem flange 42 may have a tendency to creep. Creep is also referred to as "roll-in" or "roll-out" and changes the final dimensions of the panel assembly 16 and the gap dimensions between adjacent panels 36, 38. For example, a first pass bends the hem flange 42 from ninety degrees to sixty degrees, a second pass bends the hem flange 42 from sixty degrees to thirty degrees, and a final pass bends the hem flange 42 from thirty degrees to flat. Depending on the product geometry and the material, roller hemming can be performed in only two passes, as illustrated in FIGS. 1-5. Here, the first pass bends the hem flange 42 from ninety degrees to forty five degrees and the second pass bends the hem flange 42 from forty-five degrees to flat.

Figure 2:
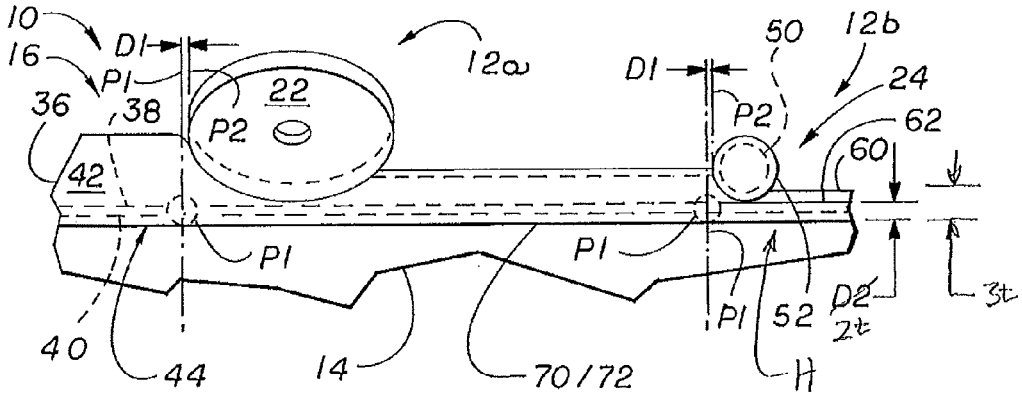
FIG. 2 is a partial front elevational view of the hemming station and associated method of FIG. 1.

The exemplary illustrated roller apparatus 12 includes a heating device 20 and a roller tool 22/24 that is either configured as a prehem roller 22 or a finishing roller 24 depending on the pass. In FIGS. 1 and 2, for purposes of illustration, the roller apparatus 12 is shown performing both passes in the same figure. Roller apparatus 12*a* performs a first pass with the roller tool 22/24 configured as the prehem roller 22 and roller apparatus 12*b* performs a second pass with the roller tool 22/24 configured as the finishing roller 24. In other embodiments, the roller apparatus 12 uses the finishing roller 24 to perform both the first pass and the second pass so that the step of changing rollers between passes is eliminated.

In still other embodiments, a roller apparatus includes multiple heating sources and/or multiple rollers to accomplish the hemming process described herein in fewer passes. For example, the two different illustrations of roller apparatus 12*a*/12*b* can be considered a single roller apparatus 12 that accomplishes the hemming method in a single pass. Alternatively, the roller apparatus 12 includes both the prehem roller 22 and the finishing roller 24.

Generally described, the roller tool 22/24 and heating device 20 are included as "end-of-arm-tooling" that is manipulated by a robot whose path is programmed to follow the perimeter of the panel assembly 16. For purposes of illustration, a robot 28 is represented by structures 29*a*, 29*b*, an actuator (e.g., motor) 30 that drives the movement of the robot 28, and a control unit 26. The control unit 26 controls the motor 30 and thus controls the speed of the robot 28.

Although a straight portion of the panel assembly 16 is illustrated, the robot 28 is configured to control or manipulate the roller tool 22/24 and the heating device 20 as a function of curvature, corners, and feature lines of a panel assembly. The axis A1 of the roller tool 22/24 is positioned at an angle A2 (see FIG. 3) by an actuator (e.g., motor) 32 that rotates the roller tool 22/24 about an axis A3. Referring to FIGS. 1-3, during the first pass, control unit 26 operates the motor 32 to set the angle A2 of the prehem roller 22 at about a forty-five degree angle with respect to the support surface 72 of the anvil 14 or otherwise so that the contact surface of the prehem roller 22 is about forty-five degrees (e.g., with respect to the support surface 72 of the anvil 14.) During the second pass, the control unit 26 operates the motor 32 to set the angle A2 of the finishing roller 24 to approximately zero degrees or otherwise so that the contact surface of the finishing roller 24 is at about zero degrees (e.g., with respect to the support surface 72 of the anvil 14). The angle for each pass may be selected as a function of various factors such as geometrical limitations, panel material, desired product quality, heating temperature, and the number of passes.

The heating device 20 may be any suitable heating device. In one embodiment, the heating device 20 is a laser. The heating device 20 is configured to be positioned (e.g., directed) to heat a heating position P1 on the hem flange 42. The direction of the heating device 20 is controlled by one or more actuators (e.g., motors) 34*a*, 34*b* that move the heating device 20, such as around axes A4, A5. The control unit 26 controls the operation of motors 34*a*, 34*b* and thus the location of the heating location P1. In some embodiments, the control unit 26 also controls a heating temperature of the heating device 20. The heating position P1 is generally located adjacent and ahead of (downstream with respect to direction X) a folding position P2 where the roller tool 22/24 contacts the hem flange 42. The heating position P1 is ahead of the folding position P2 by a distance D1 (see FIG. 2). The distance D1 may be set as a function of various factors including the speed of the robot 28, the output of the heating device 20, the temperature response of the material of the hem flange 42 to the heating device 20, and the temperature range 80 such that, at a location along the hem edge 44, the hem flange 42 is folded while the hem edge 44 is at a temperature in the temperature range 80. In other embodiments, the heating device may be an induction coil heating mechanism.

Referring to FIGS. 1, 2, 4 and 5, the finishing roller 24 is configured to bend the hem flange 42 to capture the inner edge 46 of the inner panel 38 and form a sharp hem edge 44. The finishing roller 24 illustrated in FIGS. 1-4 includes notched portions 50, 52. The radius of the first notched portion 50 is less than the radius of the second notched portion 52. The first notched portion 50 of the finishing roller 24 is configured to fold a capture portion 60 of the hem flange 42 to capture the inner edge 46 of the inner panel 38 and the second notched portion 52 is configured to fold a flat portion 62 of the hem flange 42 against the main panel 40 to minimize the outer radius R of the hem edge 44. As such, the finishing roller 24 of FIGS. 1-4 provides a hem edge 44 that is sharper as compared to a hem edge 44 formed with the un-notched finishing roller 24 of FIG. 5. The notched roller 24 is useful to provide a sharp hem edge 44, for example, when the thickness t of the inner panel 38 is greater than one millimeter.

Figure 4:
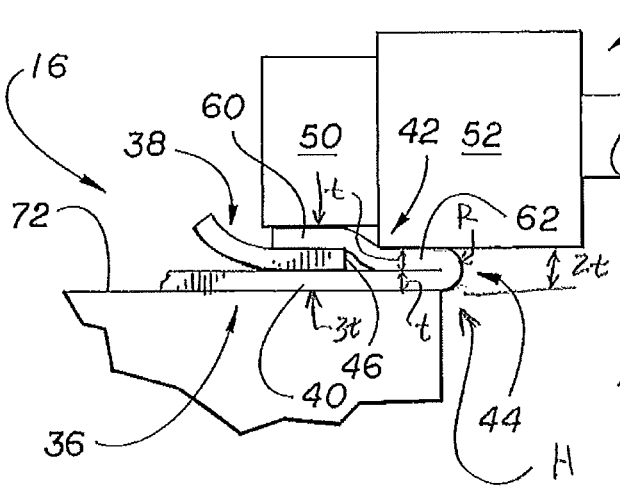
Figure 5:
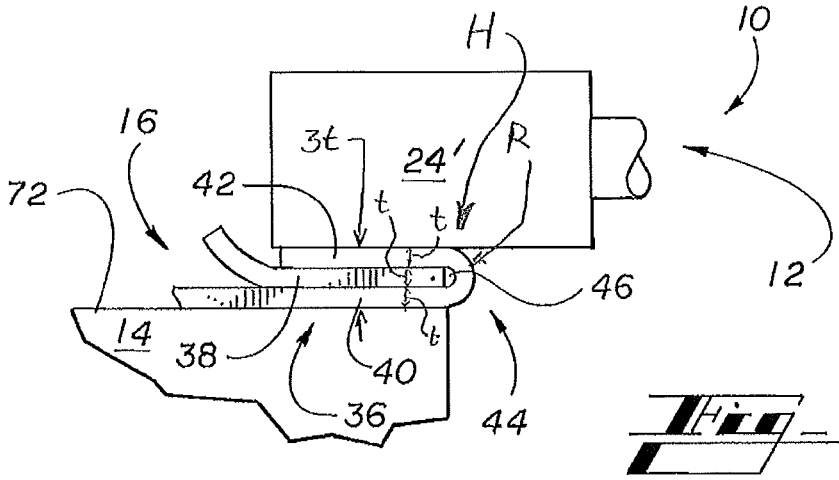
FIG. 5 is a partial side elevational view of a hemming station and associated method, according to an exemplary embodiment.

Continuing with FIGS. 2 and 4, the hem H provided by the notched finishing roller 24 is referred to as a "Dutch Hem." Hemming methods described herein enable a Dutch Hem or sharp hem edge with a "jewel-effect" to be achieved with age-hardened aluminum alloys (e.g., AA6111) and other strong alloys that are designed for a much higher strength and bake hardening response. The term "jewel-effect" generally refers to a high-quality, world-class appearance of a gap between a closure panel (e.g., door) hem edge and an edge of a body, of the perceived width of the gap, and of the sharpness of the hem edge. As used herein, the term jewel effect can refer to the sharpness or small size of a bend radius R of the outer surface of the outer panel 36 at the hem edge 44.

One way that a bend radius R that has a jewel effect can be defined is as a function of the thickness t of the outer panel 36 or the thickness nt of the hem H. For example, a sharp hem edge has a "jewel-effect" if the outside of metal (OSM) radius (bend radius) R is about equal to the thickness t of the outer panel 36 or to half the thickness 2t of the hem H (see FIG. 4). Referring to FIG. 4, the bend radius R is approximately equal to the outer panel 36 thickness t (e.g., bend radius R of t for a 2t hem thickness). Here, the inside of metal (ISM) radius is near zero.

Another way that a bend radius R that has a jewel effect can be defined is as a function of the current hem standard for steel panels. A typical steel panel hem has a bend radius R of about one millimeter. This bend radius R is about half of the total thickness 3t of three stacked sheets (e.g., the main panel 40, the inner panel 38, and the hem flange 42 as stacked in FIG. 5), each with a thickness t of 0.7 millimeters. The methods described herein allow the use of higher strength aluminum sheet and thinner gauges as compared to other methods. As such, the one millimeter standard for steel can be achieved. For example, the methods allow the use of a high strength aluminum sheet with a one millimeter sheet gauge. In this example, the hem edge 44 would have a nominal OSM bend radius R of one millimeter, which is comparable to the current hem standard for steel panels.

As mentioned above, the control unit 26 controls the motors 30, 32, 34*a*, 34*b* and the output of the heating device 20. As such the control unit 26 controls the distance D1 associated with the heating position P1 relative to the folding position P2, the speed of the robot 28, the heat output of the heating device 20 (or the temperature increase of the material). The control unit 26 controls these parameters according to optimized values such that the hem flange 42 is folded at a time when the temperature of the hem edge 44 is in the temperature range 80. It should be understood that the values for these parameters can be alternatively determined through optimization for different applications. Optimized values, such as the speed of the robot 28, are a function of properties of the material such as the speed at which the material can be heated (which depends on, for example, the heating (e.g., laser) parameters and surface emissivity) and of the strain rate sensitivity of the outer panel at the heated temperature.

An exemplary method of hemming the panel assembly 16 is now described in further detail. To begin, the panel assembly 16 is positioned on and secured to the anvil 14. The inner panel 38 is placed on the outer panel 36 with the inner edge 46 adjacent the hem edge 44 so as to be positioned to be trapped between the hem flange 42 and the main panel 40 of the outer panel 36. In positioning the panel assembly 16 on the anvil 14, the hem edge 44 of the outer panel 36 is in some embodiments positioned along the edge 70 of the anvil 14.

During the first pass, the control unit 26 positions the roller apparatus 12 at a first end of the edge 70 and traverses the roller apparatus 12 in the direction X along the edge 70 at a predetermined speed. As the roller apparatus 12 moves along the edge 70, the control unit 26 operates the heating device 20 to heat the hem edge 44 at the distance D1 (see FIG. 2) in front of the prehem roller 22. At each location along the hem edge 44, the hem edge 44 is heated by the heating device 20 and the hem flange 42 is partially folded by the prehem roller 22. During a second pass, at each location along the hem edge 44, the hem edge 44 is heated by the heating device 20 at the distance D1 in front of the finishing roller 24 and the hem flange 42 is folded flat by the finishing roller 24. With each pass, at each location along the hem edge 44, the hem edge 44 is heated and the hem flange 42 is folded while the temperature 90 of the hem edge 44 is in the temperature range 80. In the temperature range 80, the heat softens the metal and enhances its ductility to sustain the forming strain or surface strain that occurs with folding. It should be understood that the forming strains are higher for the Dutch hem shape.

For purposes of teaching, the heating and folding aspects of the method are described in further detail with respect to a single location along the length of the hem edge 44. It should be understood that the description is applicable to each location along the length of the hem edge 44. FIG. 6 illustrates the temperature 90*a*, 90*b* of the outer side (being closest to the heating device 20) of the hem edge 44 and the inner side of the hem edge 44 at the location, respectively. The shapes of the temperature curves are a function of variables including heating (e.g., laser) parameters and material characteristics such as material absorption properties.

Referring to FIGS. 1, 3, and 6, as the roller apparatus 12 moves along the edge 70, the heating device 20 rapidly heats the hem edge 44 during a heating time period 92 as it nears and passes the location. Here, the temperatures 90*a*, 90*b* rise above the temperature range 80 during and/or right after the heating time period 92. The increase in temperature 90*a*, 90*b* is partially controlled by the duration that the heat acts on that location by to the moving heating device 20. The duration is a function of the speed of the roller apparatus 12. Once the heating device 20 passes the location, the heat dissipates and the temperatures 90*a*, 90*b* begin to decline. During a folding time period 94, the temperature 90 of the hem edge 44 is within the temperature range 80. At a roller contact time 96 during the folding time period 94, the prehem roller 22 folds the hem flange 42. At the roller contact time 96, the temperature 90*a* is a folding temperature 97. The distance D1, speed of the robot 28, and heat output of the heating device 20 are controlled by the control unit 26 such that the roller contact time 96 falls in the folding time period 94 and the folding temperature 97 falls in the temperature range 80. These factors can be optimized, for example, to maximize the speed of the robot 28. Folding the hem flange 42 while it is at a temperature 90 in the temperature range 80 facilitates folding the hem flange 42 without excessively straining the outer panel 36 at the hem edge 44. In FIG. 6, the x-axis is time t (seconds), the y-axis is temperature T (degrees Celsius), the roller contact time 96 represents the folding position P2 of the roller tool 22/24, a heat time 100 represents the heating position P1, and a time period 98 represents the distance D1.

Referring to FIG. 6, in general, limits 102, 104 of the temperature range 80 vary as a function of the material of the outer panel 36. The upper limit 102 of the temperature range 80 is below the melting point of the material of the outer panel 36 and the lower limit 104 of the temperature range 80 is above room temperature. For reference, the melting point of certain 6000 series aluminum alloys is 582 to 652 degrees Celsius and room temperature can be considered to be 20 to 25 degrees Celsius. The lower limit 104 and the upper limit 102 can be set as a percentage (or other function) of the melting point. For example, certain aluminum alloys have been found to be well-hemmed with the process described herein where the limits 102, 104 are set to 20% and 50% of the melting point, respectively.

As an example of application to a certain magnesium sheet alloy, the distance D1 was selected as about thirty-five millimeters, the speed was selected as about fifty-millimeters per second, and the heating device 20 generated a temperature increase of the hem flange 42 of around two-thousand degrees Celsius per second. Here, the hem flange 42 was able to be heated and folded in less than one second. The temperature 90*a*, 90*b* of the hem flange 42 was in the temperature range 80 between one-hundred and fifty degrees Celsius and three-hundred degrees Celsius when the hem flange 42 was folded. Here, the hem flange 42 was folded when the temperature 90 of the hem flange 42 was at about one-hundred and seventy degrees Celsius.

The above-described embodiments are merely implementations that are set forth for a clear understanding of principles. Variations, modifications, and combinations of the above-described embodiments may be made without departing from the scope of the claims. All such variations, modifications, and combinations are included herein by the scope of this disclosure and the following claims.

What is claimed is:

1. A hemming station, for hemming a panel assembly including an outer panel having a hem flange defined by a hem edge and including an inner panel, comprising:

a multi-level roller configured to fold the hem flange, wherein:

the roller includes a first exterior level spaced by a first radius from a roller axis and a second exterior level being parallel to the first exterior level and spaced by a second radius from the roller axis;

the first exterior level is a first hemming level configured and arranged in the hemming station to contact and hem, to a first desired resulting shape, a first section of the outer panel;

the second exterior level is a second hemming level configured and arranged in the hemming station to contact and hem, to a second desired resulting shape, a second section of the outer panel;

the first radius is less than the second radius; and the multi-level roller, in being configured to fold the hem flange, is configured to perform, simultaneously, functions comprising:

folding, by the first hemming level of the roller, the first section of the outer panel to form a capture portion of the hem flange comprising a captured span of the inner panel captured by two capturing spans of the outer panel being parallel to each other and to the captured span of inner panel; and folding, by the second hemming level, the second section of the outer panel to form a flat portion of the hem flange wherein the outer panel is folded against itself so that an inside surface of the outer panel touches itself with is no intervening panel material between two directly-adjacent and parallel flat-portion spans of the outer panel, yielding a sharp hem edge having a minimum radius obtainable for the outer panel;

a heating device configured to heat the hem edge; and a control unit configured to control the roller and the heating device such that the roller folds the hem flange when a temperature of the hem edge is in a predetermined temperature range.

2. The hemming station of claim 1, wherein the predetermined temperature range is below a melting point of the panel assembly material.

3. The hemming station of claim 2, wherein an upper limit of the predetermined temperature range is approximately 50% of the melting point of the panel assembly material.

4. The hemming station of claim 2, wherein the predetermined temperature range is above room temperature.

5. The hemming station of claim 4, wherein a lower limit of the predetermined temperature range is approximately 20% of the melting point.

6. The hemming station of claim 1, wherein the roller is configured to provide a dutch hem shape.

7. The hemming station of claim 1, wherein the heating device is configured to heat the hem edge at a position that is adjacent to and downstream of where the roller folds the hem edge during operation of the hemming station.

8. The hemming station of claim 1, wherein:

the station is used to form a sharp hem; and the station, including multi-level roller, is configured to form, in the panel assembly:

a capture portion of the hem including a first resulting thickness being formed by the first hemming level of the roller and represented by 3T representing two instances of outer-panel thickness and an instance of inner-panel thickness; and a flat portion of the hem including a second resulting thickness being formed by the second hemming level of the roller and represented by 2T representing the two instances of outer-panel thickness, there being no inner-panel material in the flat portion.

9. The hemming station of claim 1, wherein:

the station is used to form a sharp hem; and an outside of metal (OSM) radius of the hem is equal to about a thickness of the outer panel of the panel assembly.

10. The hemming station of claim 1, wherein:

the station is used to form a sharp hem; and an outside of metal (OSM) radius of the hem is equal to about half of a thickness of the hem.

11. The hemming station of claim 7, wherein:

the position, at which heat is applied to the hem edge, is spaced by a distance from the roller; and the distance is a function of at least one factor selected from a group consisting of:

a speed of a machine controlling the roller;

an output of the heating device;

a temperature response characteristic of material of the hem flange; and the predetermined temperature range.

12. The hemming station of claim 1, wherein the control unit is configured to control the roller at an angle being a function of at least one factor selected from a group consisting of:

a panel material;

a heating temperature; and a number of passes to be made over the panel assembly.

13. A hemming station, for hemming a panel assembly including an outer panel having a hem flange defined by a hem edge and including an inner panel, comprising:

a multi-level roller configured to fold the hem flange, wherein:

the roller includes a first hemming exterior level spaced by a first radius from a roller axis and a second hemming exterior level being parallel to the first hemming exterior level and spaced by a second radius from the roller axis; and the multi-level roller, in being configured to fold the hem flange, is configured to perform functions comprising:

folding, by the first hemming exterior level of the roller, a capture portion of the hem flange to capture an inner edge of the inner panel; and folding, by the second hemming exterior level, a flat portion of the hem flange against itself with no intervening panel material, to form a sharp hem edge having a minimum radius obtainable for the outer panel;

a heating device configured to heat the hem edge; and a control unit configured to:

control the roller and the heating device such that the roller folds the hem flange when a temperature of the hem edge is in a predetermined temperature range; and control the roller at an angle being a function of at least one factor selected from a group consisting of:

a panel material;

a heating temperature; and a number of passes to be made over the panel assembly.

14. The hemming station of claim 13, wherein:

the heating device is configured to heat the hem edge at a position that is adjacent to and downstream of where the roller folds the hem edge during operation of the hemming station;

the position, at which heat is applied to the hem edge, is spaced by a distance from the roller; and the distance is a function of at least one factor selected from a group consisting of:

a speed of a machine controlling the roller;

an output of the heating device;

a temperature response characteristic of material of the hem flange; and the predetermined temperature range.

15. A hemming station, for hemming a panel assembly including an outer panel having a hem flange defined by a hem edge and including an inner panel, comprising:

a multi-level roller configured to fold the hem flange, wherein:

the roller includes a first hemming exterior level spaced by a first radius from a roller axis and a second hemming exterior level being parallel to the first hemming exterior level and spaced by a second radius from the roller axis;

the first radius is less than the second radius; and the multi-level roller, in being configured to fold the hem flange, is configured to perform functions comprising:

folding, by the first hemming exterior level of the roller, a capture portion of the hem flange to capture an inner edge of the inner panel; and folding, by the second hemming exterior level, a flat portion of the hem flange against itself with no intervening panel material, to form a sharp hem edge having a minimum radius obtainable for the outer panel;

a heating device configured to heat the hem edge; and a control unit configured to control the roller and the heating device such that the roller folds the hem flange when a temperature of the hem edge is in a predetermined temperature range;

wherein:

the heating device is configured to heat the hem edge at a position that is adjacent to and downstream of where the roller folds the hem edge during operation of the hemming station;

the position, at which heat is applied to the hem edge, is spaced by a distance from the roller; and the distance is a function of at least one factor selected from a group consisting of:

a speed of a machine controlling the roller;

an output of the heating device;

a temperature response characteristic of material of the hem flange; and the predetermined temperature range.

16. The hemming station of claim 15, wherein the control unit is configured to control the roller at an angle being a function of at least one factor selected from a group consisting of:

a panel material;

a heating temperature; and a number of passes to be made over the panel assembly.

* * * * *